US008336759B2

(12) United States Patent
Skouboe

(10) Patent No.: US 8,336,759 B2
(45) Date of Patent: Dec. 25, 2012

(54) PARCEL BOX FOR RECEIVING AND KEEPING PARCELS IN A THEFTPROOF MANNER

(76) Inventor: Peter Skouboe, Gentofte (DK)

( * ) Notice: Subject to any disclaimer, the term of this patent is extended or adjusted under 35 U.S.C. 154(b) by 0 days.

(21) Appl. No.: 13/264,454

(22) PCT Filed: Apr. 6, 2010

(86) PCT No.: PCT/EP2010/054556

§ 371 (c)(1),
(2), (4) Date: Oct. 14, 2011

(87) PCT Pub. No.: WO2010/118972

PCT Pub. Date: Oct. 21, 2010

(65) Prior Publication Data

US 2012/0024942 A1 Feb. 2, 2012

(30) Foreign Application Priority Data

Apr. 17, 2009 (EP) ..... 09158120

(51) Int. Cl.
*B65G 11/04* (2006.01)

(52) U.S. Cl. ..... 232/47; 232/45; 312/211; 312/333

(58) Field of Classification Search ..... 232/44–45, 232/47–51, 17, 24; 312/211–212, 330.1, 312/333, 334.1

See application file for complete search history.

(56) References Cited

U.S. PATENT DOCUMENTS

| | | | | | |
|---|---|---|---|---|---|
| 1,417,773 | A | | 5/1922 | Schulze | |
| 1,471,899 | A | * | 10/1923 | Koenig | 232/17 |
| 1,472,690 | A | * | 10/1923 | Skinner | 232/12 |
| 1,558,026 | A | | 10/1925 | Lyons | |
| 3,099,389 | A | * | 7/1963 | Vadnai | 232/24 |
| 3,401,875 | A | * | 9/1968 | Bruhns | 232/34 |
| 4,278,308 | A | * | 7/1981 | Gotberg | 312/330.1 |
| 4,344,661 | A | * | 8/1982 | Gotberg | 312/330.1 |
| 4,753,386 | A | * | 6/1988 | Phillion, Sr. | 232/43.1 |
| 4,844,332 | A | * | 7/1989 | Long | 232/17 |
| 5,833,132 | A | * | 11/1998 | Bachmeier | 232/47 |

(Continued)

FOREIGN PATENT DOCUMENTS

| | | | |
|---|---|---|---|
| CH | 583 544 | A5 | 1/1977 |
| CH | 597 810 | A5 | 4/1978 |
| WO | 01/15579 | A1 | 3/2001 |
| WO | 01/93729 | A1 | 12/2001 |
| WO | 03/026466 | A1 | 4/2003 |

OTHER PUBLICATIONS

International Search Report from PCT/EP2010/054556 dated Jul. 20, 2010 (2 pages).

(Continued)

*Primary Examiner* — William L. Miller
(74) *Attorney, Agent, or Firm* — Osha Liang LLP

(57) ABSTRACT

A parcel box for receiving and keeping parcels in a theftproof manner has a box having a drawer which can be pulled out and pushed in, and a prevention mechanism that prevents unauthorized removal of parcel. The prevention mechanism has a platform for placing parcel, a blocking mechanism that blocks pulling out of the drawer from the box when parcel is placed on the platform, and an unblocking mechanism that unblocks the parcel box drawer. The platform has a first end and a second end situated opposite each other. The platform is swingable about a cross pivot axle fixed in the drawer. The first end of the platform is situated lower than the second end. The blocking mechanism has a blocking bracket and a stop. The blocking bracket has a first end and a second end situated opposite each other.

19 Claims, 6 Drawing Sheets

U.S. PATENT DOCUMENTS

| | | | | |
|---|---|---|---|---|
| 6,375,071 | B1 * | 4/2002 | Kim | 232/47 |
| 6,588,656 | B2 * | 7/2003 | Cox et al. | 232/47 |
| 6,655,577 | B2 * | 12/2003 | Mihaylov et al. | 232/45 |
| 7,036,719 | B1 * | 5/2006 | Helphrey et al. | 232/47 |
| 7,175,068 | B2 * | 2/2007 | Fitzgibbons et al. | 232/31 |
| 7,182,246 | B1 * | 2/2007 | Sievel | 232/45 |
| 7,249,705 | B2 * | 7/2007 | Dudley | 232/47 |
| 7,913,898 | B2 * | 3/2011 | Frankenberg et al. | 232/45 |
| 2005/0258227 | A1 | 11/2005 | Flores | |
| 2012/0031960 | A1 * | 2/2012 | Skouboe | 232/47 |

OTHER PUBLICATIONS

Written Opinion from PCT/EP2010/054556 dated Jul. 20, 2010 (3 pages).
International Search Report from PCT/EP2010/054557 dated Aug. 19, 2010 (3 pages).
Written Opinion from PCT/EP2010/054557 dated Aug. 19, 2010 (4 pages).

* cited by examiner

PARCEL BOX FOR RECEIVING AND KEEPING PARCELS IN A THEFTPROOF MANNER

BACKGROUND

1. Technical Field

This invention relates to apparatus for ensuring the secure delivery of mail and parcels to household or business premises. More specifically, the invention relates to parcel box for receiving and keeping parcels in a theft-proof manner.

2. Background Art

With a growing internet trade and purchase of goods online there has been an increase in the delivery of goods to the home. Since ordered goods are usually too big to fit through standard mail box, to ensure safe receipt of the ordered goods the customer is required either to be at home at the moment of delivery, or to collect these goods from a post office or seller's storehouse. Therefore there is a need in parcel box on the one part having sufficient capacity to be able to receive large-size articles, and on the other part having means preventing unauthorized removal of articles delivered in absence of addressee.

There are known parcel boxes with different types of locking mechanisms for secure delivery of parcels having a door with means for locking the door when parcel is placed in the parcel room.

Different types of locking mechanisms for parcel box are suggested in CH 597810 ("Mail box", Int. C1.2 A47G 29/16, publ. Apr. 14, 1978). According to invention disclosed in CH 597810, it is suggested using box in the form of parallelepiped having single-swing door. The door's locking is ensured by lever with latch being put in position of locking by pushing or pulling means actuated by restoring spring and parcel placed in the parcel room. In one embodiment of the known technical solution, the parcel when being put in the parcel room pushes the plate, which actuates lever with latch locking the door of the parcel box. In the another embodiment, the weight of parcel put in the parcel room forces platform downward, which actuates lever with latch locking the door of the parcel box. The door is then unlocked by the owner's key. A major drawback of the known device is that the locking arrangement located in the inner part of the parcel box requires much space for its operation, thus limiting the usable inner area of the parcel box and the size of the parcel, which may be placed therein. Moreover, such locking arrangement contains a number of elements, which have quite short durability and thus limiting the life time of the locking arrangement.

There is known a parcel box having a single-swing door openable, when no parcel is in the box, wherein, once closed with a parcel placed in the box, the door is blocked thereby preventing unwanted removal of the parcel placed therein (WO01/15579A1 "Secure article delivery apparatus and method", Int. C1.$^7$ A47G 29/14, publ. Mar. 8, 2003). When a parcel is placed in the box on a raised platform, the weight of the parcel forces the platform downwardly, against the action of biasing means such as helical or leaf springs. Once the parcel has been placed in the box, the door is closed. During the closure process the platform is lifted by cam means attached to door. As a result a dowel attached to the side of platform rises above a latch fitted to the inside face of the door as part of projection. At the moment that the door is fully closed, dowel overlies a recess formed by latch. Simultaneously, wedges line up with recesses provided in platform and the platform drops under the influence of the weight of the parcel placed thereon. Locking means such as a key operated lock attached to the side of the box prevents a lower portion of the latch from being pushed back and releasing the door. If a parcel is on the platform, the only way of opening the door is to unlock the lock which frees dowel. A major drawback of the known parcel box is that proper work of the locking arrangement depends on which part of the raised platform the parcel is placed. Also, the lifetime of the locking arrangement is limited due to using of springs and other parts which have limited work resources.

There is known a parcel box (WO/2003/026466 "A case for receiving and keeping parcels in a theftproof manner", Int. C1.7 A47G 29/20, publ. Apr. 3, 2003) with a door pivotally mounted on the case of the box by means of hinges and having locking arrangement with a pivotal locking lever, which is fitted between two bottoms of the parcel box, and is connected to the lower end part of the locking bar at one end and at the other end, to a swing axle extending transversally of the locking lever and rotatably journaled in the upper bottom. The swing axle is provided with projecting supporting arm which has a support base located at a distance from the swing axle, and that the support base is supporting against the lower bottom when the upper bottom is forced down towards the lower bottom by the weight of parcel placed on the upper bottom. When the parcel is weighing the movable upper bottom down towards the fixed lower bottom, the support base is made to support against the last mentioned bottom. Thereby, the supporting arm pivots the swing axle and thereby the swing arm which again pushes the locking bar up or down so that the locking arrangement is activated. The main drawback of the known parcel box is also insufficient reliability of the locking arrangement. For proper work of the case the parcel should be placed on upper bottom over transversally extending swinging axle or sufficiently close to it. In case a postman will place the parcel at a distance from the transversally extending swinging axle, the locking arrangement will not work properly.

There is known a parcel box (U.S. Pat. No. 1,417,773 "Deposit and collection receptacle", Int. C1. A47G 19/20, publ. May, 30, 1922) comprising a receptacle provided with an inwardly swinging door, a floor within the receptacle supported for swinging movement, a portion of the floor adjacent the door normally swinging downwardly by gravity, and a latch pivotally supported by said portion of the floor and normally swinging upwardly, said normally depressed portion of the floor swinging upwardly upon imposing weight upon the opposite portion of the floor, said latch holding the door against inward swinging movement when said normally depressed portion of the floor is elevated.

Large sized parcel boxes are usually placed on the floor inside or outside of household properties. In the apartment buildings a number of parcel boxes may be put one to another.

To put a parcel in the parcel box standing on the level, which is lower than the user's waist, the user has to bend down or squat. The user taking out the parcel has to perform similar operations and reach to the parcel placed deep in the parcel box. In such cases another disadvantage of the known parcel boxes is that they are quite inconvenient in use, especially when placed on the floor.

SUMMARY

One or more embodiments of the present invention provides a parcel box for receiving and keeping parcels in a theftproof manner.

A parcel box according to one or more embodiments of the present invention comprises a sufficient capacity to be able to receive large-sized articles, means preventing unauthorized removal of articles delivered in absence of addressee, simple, inexpensive, reliable and easy-to-use construction, as well as is convenient in use, especially when placed on the floor or standing on the level, which is lower than its owner's waist.

A parcel box according to one or more embodiments of the present invention comprises a box, a drawer and means preventing unauthorized removal of parcel, comprising a platform for placing parcel, means blocking pulling out of the drawer from the box when parcel is placed on the platform and means for unblocking opening the parcel box drawer.

According to one or more embodiments of the present invention, a means blocking pulling out of the drawer from the box when parcel is placed on the platform comprises a blocking bracket having a first end and a second end situated opposite each other, the blocking bracket being swingable about a cross pivot axle, fixed in the drawer, the platform having a first and a second end situated opposite each other, the platform being swingable about a cross pivot axle fixed in the drawer, at that the first end of the platform is situated lower than the second end and is engaged or hingedly connected with the first end of the blocking bracket, a stop fixed in the box for engagement with the second end of the blocking bracket when parcel is placed on the second end of the platform and thereby the second end of the blocking bracket is in its lower position.

According to one or more embodiments of the invention, the blocking bracket comprises a first end forming a hook, a second end forming a catch and a cramp having aperture for axle. The cramp is located on the upper part of the blocking bracket, closer to the hook; thereby the catch outweighs the hook. The hook is inserted into the opening in the weight (counterbalance), so that when the weight outweighs the second end of the platform, it engages the hook and when the parcel outweighs the first end of the platform, the hook is disengaged and allows the blocking bracket to freely move in the opening. The drawer also comprises the stop for engagement with catch, as well as means for disengagement of catch from stop. When there is no parcel on the platform the weight holds the catch in disengaged position. In this position the drawer can be pulled out and pushed in again and again. When the parcel is put on the platform, the second end of the platform goes down, thus causing the first end of the platform to go up. By going up, the second end disengages the hook. The catch, forced by gravitation, falls down. As soon, as the drawer is pushed into the box, the catch engages with the stop, thus blocking pulling out of the drawer from the box.

Use of drawer ensures the convenience in use of the parcel box, especially when placed on the floor or standing on the level, which is lower than its owner's waist. To put in or take out the parcel, the user has to pull out the drawer and put or take the parcel. That is much more convenient than use of traditional parcel box with single swing door pivotally mounted on the case of the box. According to one or more embodiments of the present invention, the drawer is mounted on guiding means, such as rails or guide roller.

The means for preventing unauthorized removal of parcel according to one or more embodiments of the present invention have simple, inexpensive, reliable and easy-to-use construction; they are sufficiently sensitive to react on lightweight parcel, regardless on which part of the platform the parcel is placed. However weight sensitivity of the parcel box can also be adjusted, according to needs. The offered means for preventing unauthorized removal of parcel allow using simple mechanism of the means for signaling the presence of the parcel in the parcel box. Also, the suggested means for preventing unauthorized removal of parcel have longer lifetime if compared with the most of prior art technical solutions.

Further, substance of the invention and its various embodiments are described by way of examples with references to the drawings.

DETAILED DESCRIPTION

Hereafter, embodiments of the invention will be described. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
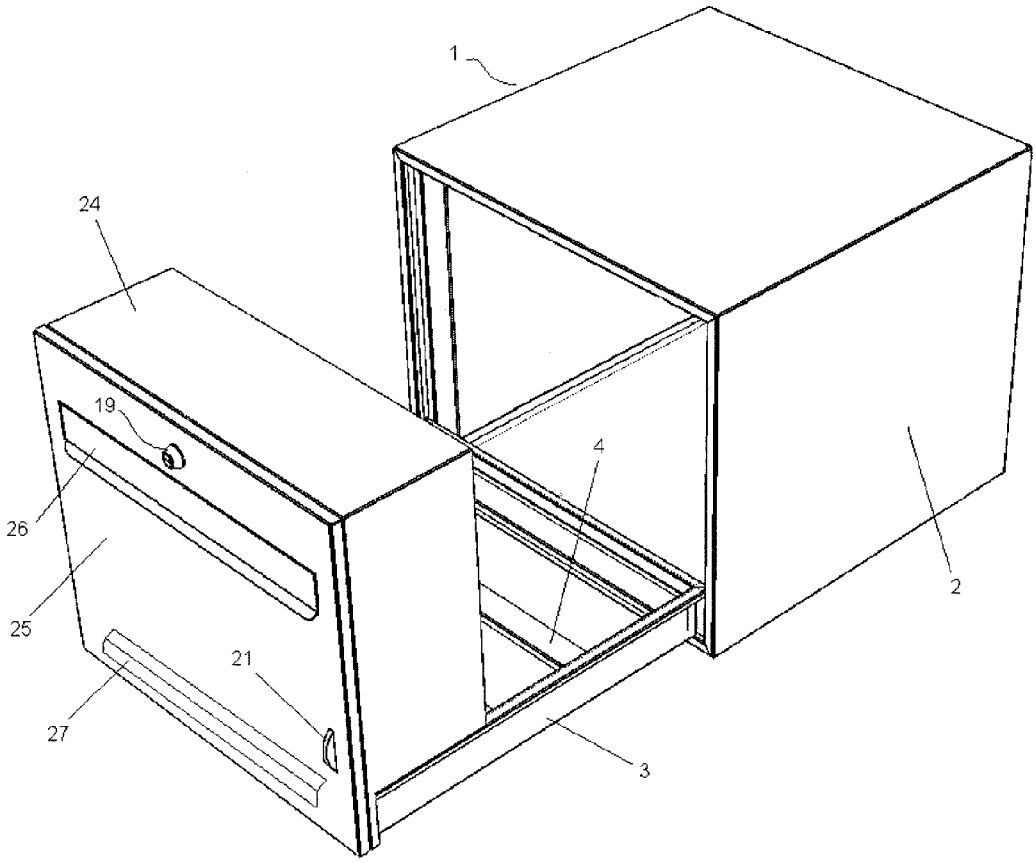
FIG. 1 represents general view of the combined mail and parcel box.
Figure 2:
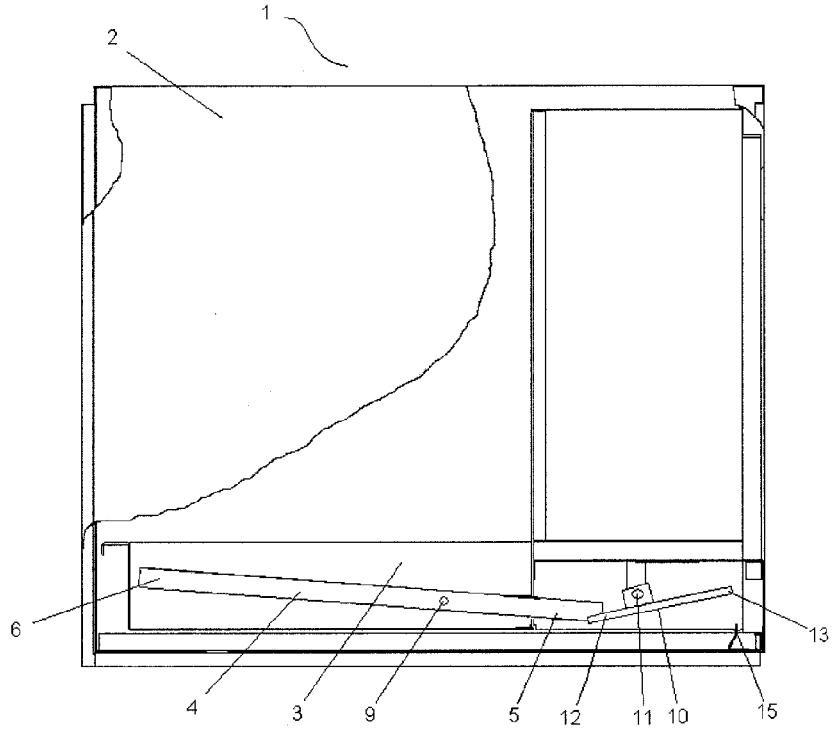
FIG. 2 represents schematic view of the means blocking opening the parcel box in position when there is no parcel in the parcel box.
Figure 3:
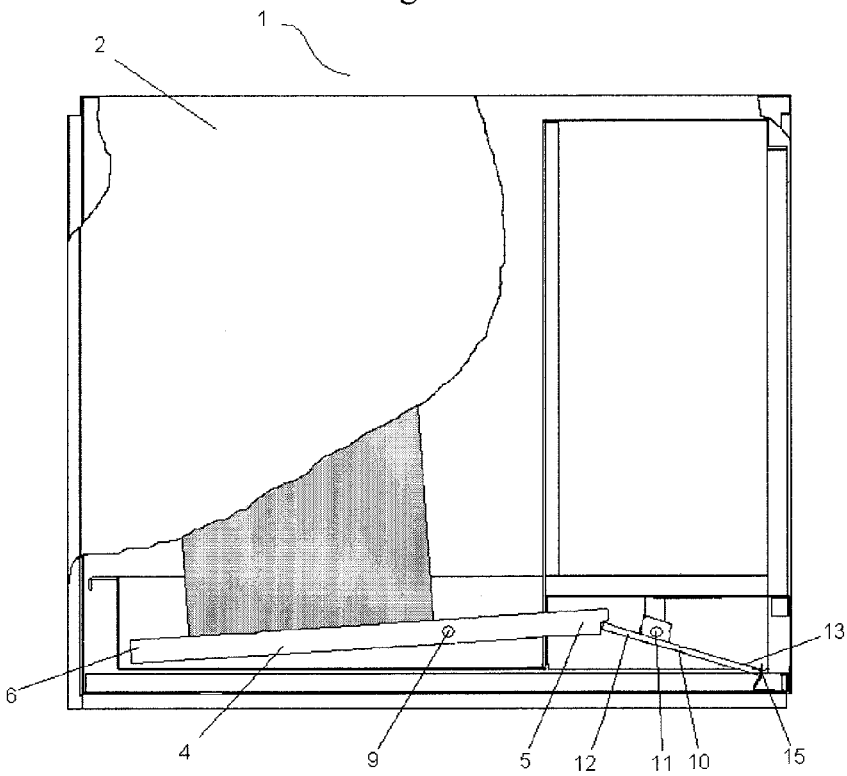
FIG. 3 represents schematic view of the means blocking opening the parcel box in position when there parcel in the parcel box.
Figure 4:
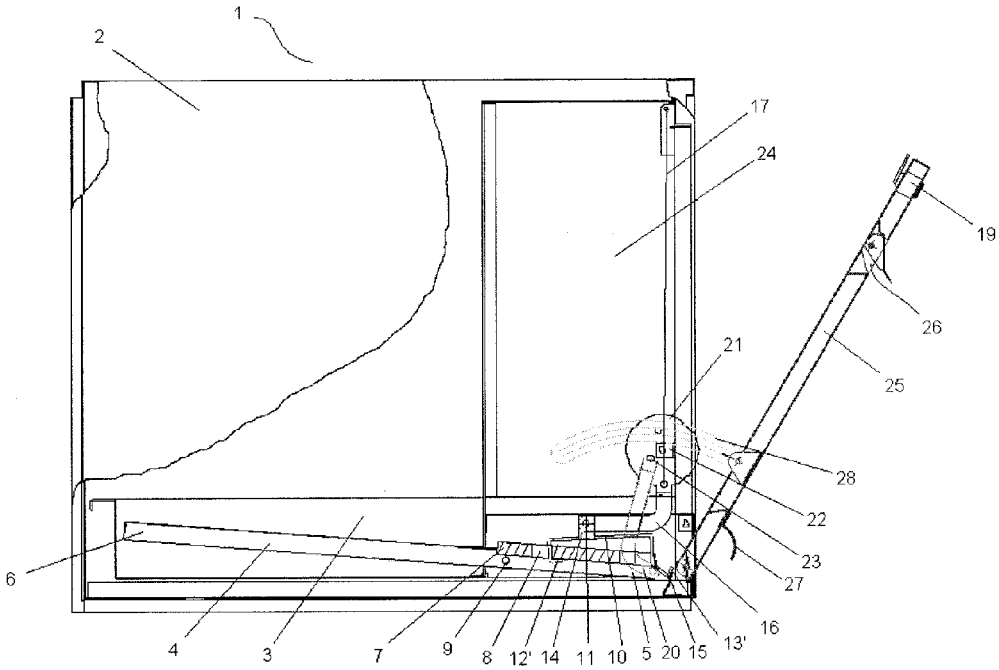
FIG. 4 represents side view of embodiment of the combined mail and parcel box in unblocked position (with no parcel inside).
Figure 5:
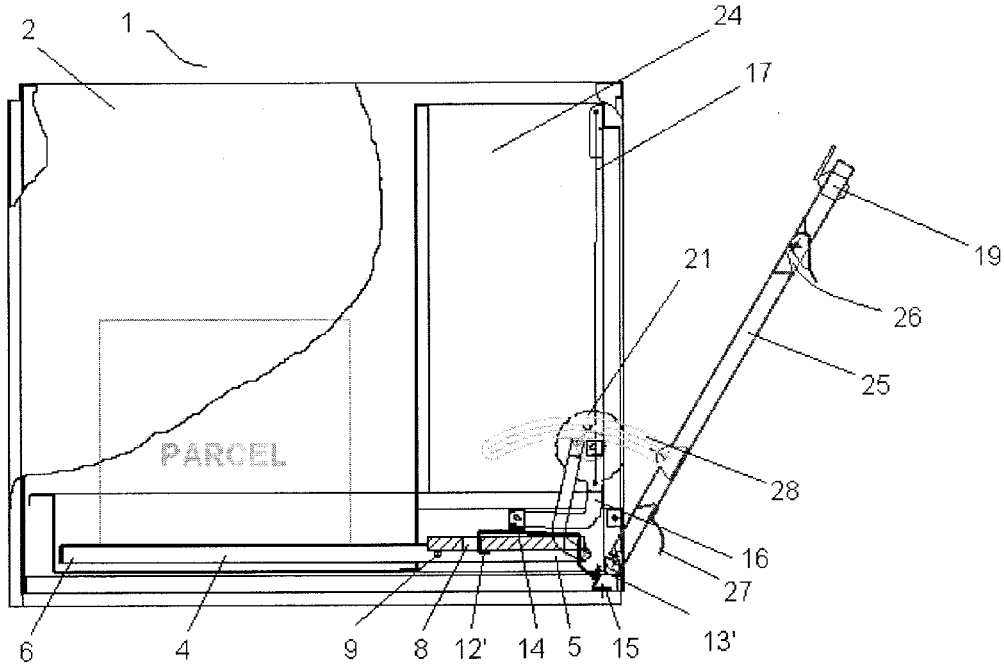
FIG. 5 represents side view of embodiment of the combined mail and parcel box in blocked position (when the parcel is inside).
Figure 6:
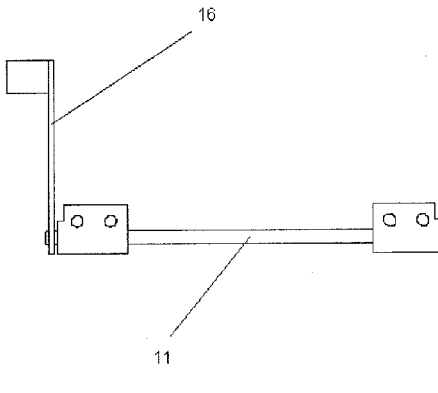
FIG. 6 represents top view of one embodiment of the means blocking opening the parcel box.
Figure 7:
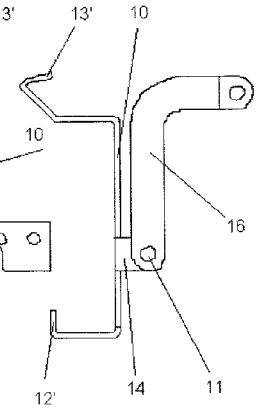
FIG. 7 represents side view of one embodiment of the means blocking opening the parcel box.

Parcel box 1 for receiving and keeping parcels in a theft-proof manner comprises a box 2 and a drawer 3 (FIG. 1). The drawer 3 comprises a platform 4 having a first 5 and a second 6 end situated opposite each other (FIGS. 2 and 3). The first end 5 is provided with or connected to weight (counterbalance) 7. The weight 7 or the first end 5 of the platform 4 has an opening 8 (FIG. 4). The platform 4 is swingable about a cross pivot axle 9 fixed in the drawer 3. The axle 9 is placed in parallel to imaginary line dividing the first end 5 from the second end 6. The first end 5 of the platform 4 is situated lower than the second end 6. The first end 5 according to one or more embodiments of the present invention is shorter than the second end 6. In such embodiment the first end 5 is forced down by the weight 7 thereby the second end 6 is situated higher than the first end 5. The drawer 3 also comprises a blocking bracket 10 pivotally mounted on axle 11, which is fixed in the drawer 3, according to one or more embodiments of the present invention, above the first end 5 of the platform 4 (FIG. 2-FIG. 10). Said blocking bracket 10 comprises a first end 12 and a second end 13 situated opposite each other, the blocking bracket 10 being swingable about a cross pivot axle 11 is fixed in the drawer 3. The first end 5 of the platform 4 is engaged or hingedly connected with the first end 12 of the blocking bracket 10. In one or more embodiments of the present invention, the first end 12 of the blocking bracket 10 forms a hook 12', and second end 13 forms a catch 13' (FIG. 4-FIG. 10). The blocking bracket 10 may also comprise a cramp 14 having aperture for axle 11. The cramp 14 is located on the upper part of the blocking bracket 10, closer to the hook 12' (i.e. the second end of the blocking bracket 10 is longer than the first end); thereby the second end of the blocking bracket 10 forming catch 13' outweighs the first end forming a hook 12' when the hook 12' is not engaged with the first end 5 of the platform 4. The hook 12' is inserted into the opening 8 in the weight 7 or in the first end 5 of the platform 4 so that when the weight 7 outweighs the second end 6 of the platform 4, it engages the hook 12' and when the parcel outweighs the first end 5 of the platform 4, the hook 12' is disengaged and allows the blocking bracket 10 to move up in the opening 8. The box 2 comprises a stop 15 for engagement with the second end 13 of the blocking bracket 10 (in the second embodiment—with the catch 13') when parcel is placed on the second end 6 of the platform 4 and thereby the second end 13 of the blocking bracket 10 is in its lower position.

Figure 8:
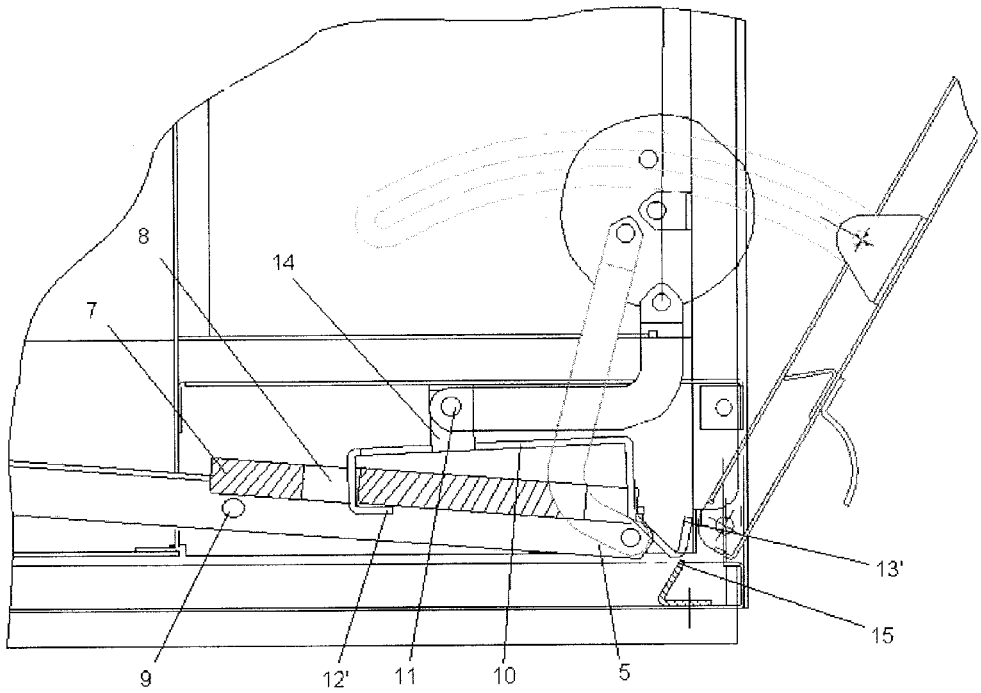
FIG. 8 is the enlarged side view of part of the combined mail and parcel box in unblocked position (when there is no parcel inside).
Figure 9:
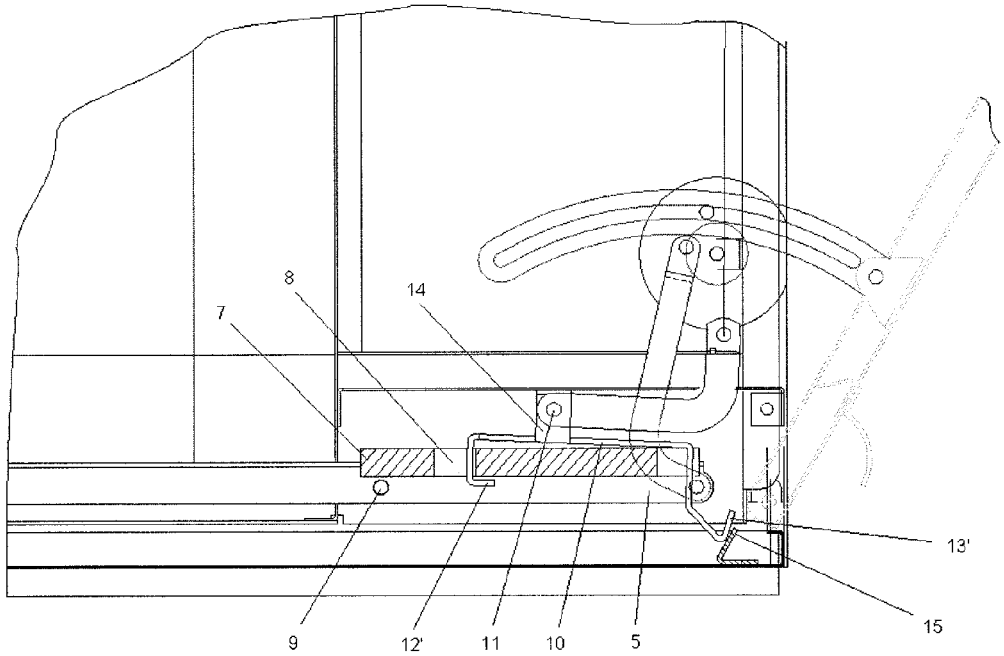
FIG. 9 is the enlarged side view of part of the combined mail and parcel box in blocked position (with parcel inside).
Figure 10:
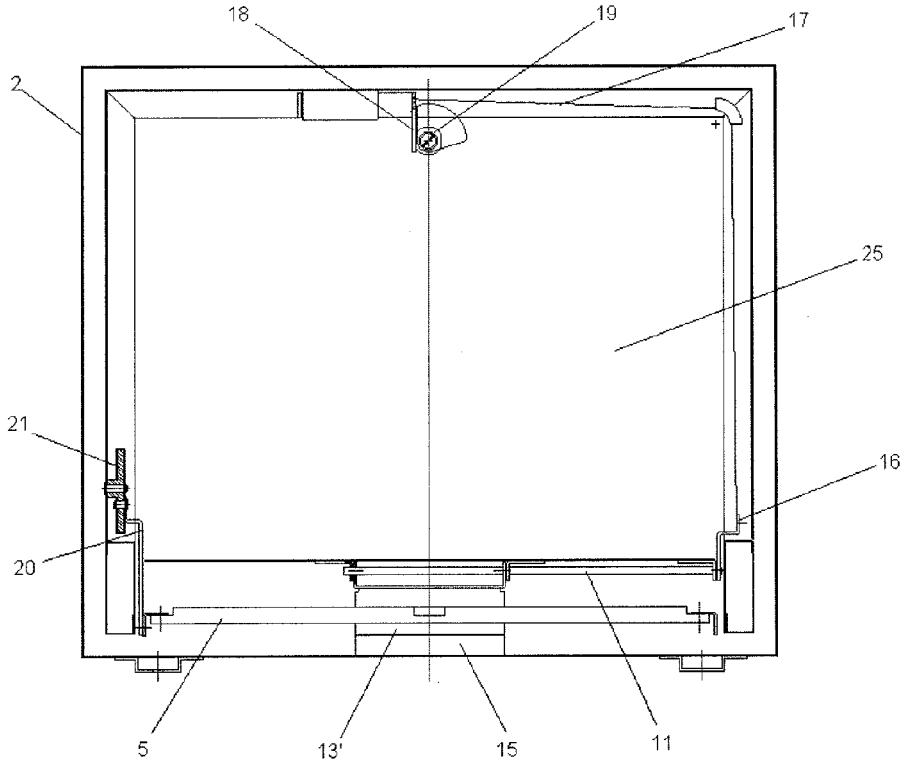
FIG. 10 represents cross-section of the front view of the combined mail and parcel box.

The drawer 3 also comprises the means for unblocking opening of the parcel box drawer. These means comprise the means for disengagement of the catch 13' from the stop 15. According to one or more embodiments of the invention, the means for disengagement of the catch 13' from the stop 15 comprise lever 16 having a first and a second end, a wire rope 17, a rocker arm 18 and a lock 19 (FIG. 4-FIG. 10). The first end of the lever 16 is pivotally mounted on the axle 11 and fixed to the cramp 14, but the second end of the lever 16 is connected to the wire rope 17, which, in turn, is connected to the rocker arm 18 (FIG. 10). In another embodiment, the means for disengagement of catch 13' from stop 15 comprise a wire rope 17, a rocker arm 18 and a lock 19. The first end of the wire rope 17 is fixed directly to the second end of the blocking bracket 10 forming catch 13, but the second end of the wire rope 17 is connected to the rocker arm 18.

Also, the drawer 3 may contain a signalling device comprising a lever 20 and signalling means 21 for signaling the presence of the parcel in the parcel box 1. According to one embodiment of the invention, the signaling means 21 are in the form of a disc mounted pivotally on the cramp 22 and placed in the slit in the outer wall of the drawer 3 so that the peripheral part of signaling means 21 is visible outside of the parcel box 1 (FIG. 8-FIG. 10). According to another embodiment (FIG. 11), the signaling means 21 are in the form of a plate placed in parallel to the outer wall of the drawer 3 on a level of an aperture in this outer wall so that the outer part of signaling means 21 is visible through the said aperture in the outer wall of the drawer 3, at that the signaling means 21 are mounted so as to allow their vertical sliding translational movement along the said outer wall of the drawer 3. One end of the lever 20 is pivotally connected to the axle 23 on the signaling means 21. The other end of the lever 20 is fastened to the first end 5 of the platform 4. The signaling device 21 is provided by color label, notch or cut off on its peripheral or outer part allowing user to distinguish between "empty" and "parcel inside" positions.

According to one or more embodiments of the invention, the drawer 3 is mounted on guiding means, such as rails, wheels, guide rollers or equivalent means allowing easily drawing out and pushing in the drawer 3. The drawer 3 may also contain means, such as magnet or spring, for ensuring closing the drawer back (attracting or pulling up) even when the drawer is not properly closed by the user. The parcel boxes may either be mounted on the wall of a building, placed on the floor and put one on top another, or be in the form of a cabinet.

Figure 11:
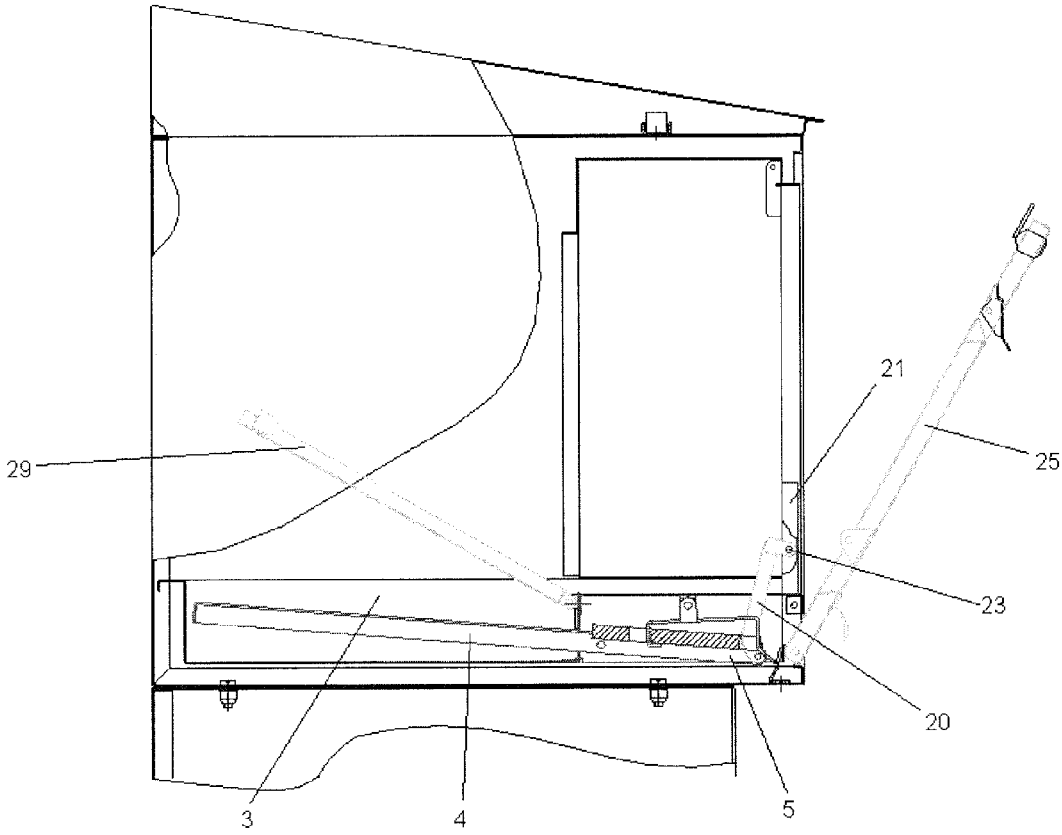
FIG. 11 represents side view of another embodiment of the combined mail and parcel box in unblocked position (when there is no parcel inside).

The parcel box 1 may be combined with mail box so that both boxes would work independently—the mail box is working as a traditional letter box and third party can deliver letters in the mail box at all time; deliveries in the mail box would not influence the parcel box, if the parcel box is empty it will still be able to open even if there are deliveries in the mailbox. The mail box according to one or more embodiments is placed in front of the drawer 3, above the first end 5 of the platform 4 and blocking bracket 10 (FIGS. 1 and 4). The mail box comprises a box 24 and a door 25. The door 25 is pivotally mounted on the drawer 3 and forms its outer wall. The door 25 comprises a letter opening 26, a handle and/or door's support 27, a guiding bracket 28 and lock 19. According to one or more embodiments of the present invention, the wall 29 of the mail box, which is opposite to the door 25 is also swingably mounted on the drawer 3 so that the upper part of the wall 29 can be put down on the platform 4 (FIG. 11). The wall 29 is equipped with means for releasably holding it in the closed position as shown on FIG. 4 and allowing opening it as shown on FIG. 11. Opening of the wall 29 allows increasing the space of the mail box. That is especially convenient during long-time absence of user, which is connected with accumulation of large number of mail. When holding means are released, the upper part of the wall 29 goes down and lies on the second end 6 of the platform 4, thereby acting as a parcel placed on the platform 4 and causing the catch 13' to engage with the stop 15. Thus, using the suggested construction allows increasing the space of the mail box and simultaneously blocking pulling out of the drawer from the box preventing unauthorized access to the mail.

In a "waiting position", i.e. when there is no parcel on the platform 4, the weight 7 outweighs the first end 5 of the platform 4. In this position, the weight 7 engages the hook 12' and holds the blocking bracket 10 in such a position that the hook is situated lower than the catch 13'. Thereby, when there is no parcel on the platform 4 the weight 7 holds the catch 13' in disengaged position. In this position the drawer 3 can be pulled out and pushed in again and again.

When the parcel is delivered, the courier pulls out the drawer 3, puts the parcel on the platform 4 (either closer to the second end 6 or closer to the axle 9). Being forced down by the weight of parcel, the second end 6 of the platform 4 goes down, thus causing the first end 5 of the platform 4 to go up. By going up, the second end 6 disengages the hook 12'. Since the second end of the blocking bracket 10 forming the catch 13' is heavier (the second end has longer arm) than the first end of the blocking bracket 10, the catch 13' outweighs the hook 12' when the last is disengaged. Thereby the catch 13, forced by gravitation, falls down. As soon, as the drawer is pushed into the box 2, the catch 13' engages with the stop 15, thus blocking pulling out of the drawer 3 from the box 2 and preventing unauthorized removal of parcel.

To unlock the parcel box 1, the user inserts the key into the lock 19 and turns the key thereby turning the lock's 19 claw or equivalent means, which engage with the rocker arm 18 and pushes it aside. Since the rocker arm 18 is connected to the lever 16 by the wire rope 17 or equivalent means, when turning the key and pushing aside the rocker arm 18, the user raises the second end of the lever 16, which raises the second end of the blocking bracket 10 forming the catch 13, thus disengaging the catch 13' from the stop 15. When the catch 13' is disengaged from the stop 15, the drawer 3 can be pulled out from the box 2 giving the user access to the parcel. To unlock the mail box, the user inserts the key into the lock 19 and turns the key thereby turning the lock's 19 claw or equivalent means, which engage with the rocker arm 18 to the direction opposite to the direction for opening the parcel box 3.

If the parcel box is equipped with the signaling device the user can see whether there is a parcel in the parcel box from a distance. When there is no parcel in the parcel box 1, the signaling device 21 is set to position "empty", which may be marked by green color. When the parcel is placed on the second end 6 of the platform 4, the first end 5 being forced up by the weight of the parcel goes up, thus pushing up the lever 20, which pivots the signaling device 21 in position "parcel inside", which may be marked by red color, notch or cut off.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A parcel box for receiving and keeping parcels in a theftproof manner comprising:

a box comprising a drawer which can be pulled out and pushed in; and a prevention mechanism that prevents unauthorized removal of a parcel, comprising:

a platform for placing the parcel, a blocking mechanism that blocks pulling out of the drawer from the box when the parcel is placed on the platform, and an unblocking mechanism that unblocks the parcel box drawer, wherein the platform has a first end and a second end situated opposite each other, wherein the platform is swingable about a first cross pivot axle fixed in the drawer, wherein the first end of the platform is situated lower than the second end, wherein the blocking mechanism comprises a blocking bracket and a stop, wherein the blocking bracket has a first end and a second end situated opposite each other, wherein the blocking bracket is swingable about a second cross pivot axle, fixed in the drawer, whereby the first end of the blocking bracket is engaged or hingedly connected with the first end of the platform, and wherein the stop is fixed in the box for engagement with the second end of the blocking bracket when the parcel is placed on the second end of the platform and thereby the second end of the blocking bracket is in a lower position.

2. The parcel box according to claim 1, wherein the first end of the platform is shorter than the second end, and a weight is provide at that the first end so that the first end outweighs the second end when there is no parcel on the second end of the platform.

3. The parcel box according to claim 2, wherein the first end of the blocking bracket forms a hook for engagement with the first end of the platform and the second end forms a catch for engagement with the stop when the parcel is placed on the second end of the platform, hereto the blocking bracket is mounted on the second cross pivot axle so that the catch outweighs the hook when the hook is not engaged with the first end of the platform.

4. The parcel box according to claim 3, wherein the hook is inserted into the opening in the weight or in the first end of the platform so that when the weight outweighs the second end of the platform, the weight engages the hook thereby outweighing the catch, and when the parcel outweighs the first end of the platform, the hook is disengaged and allows the blocking bracket to move up in the opening, thereby allowing the catch to outweigh the hook and engage with the stop.

5. The parcel box according to claim 2, wherein the unblocking mechanism comprises a disengagement mechanism that disengages a catch from the stop.

6. The parcel box according to claim 3, wherein the unblocking mechanism comprises a disengagement mechanism that disengages the catch from the stop.

7. The parcel box according to claim 4, wherein the unblocking mechanism comprises a disengagement mechanism that disengages the catch from the stop.

8. The parcel box according to claim 1, wherein the first end of the blocking bracket forms a hook for engagement with the first end of the platform and the second end forms a catch for engagement with the stop when the parcel is placed on the second end of the platform, hereto the blocking bracket is mounted on the second cross pivot axle so that the catch outweighs the hook when the hook is not engaged with the first end of the platform.

9. The parcel box according to claim 8, wherein the hook is inserted into the opening in a weight or in the first end of the platform so that when the weight outweighs the second end of the platform, the weight engages the hook thereby outweighing the catch, and when the parcel outweighs the first end of the platform, the hook is disengaged and allows the blocking bracket to move up in the opening, thereby allowing the catch to outweigh the hook and engage with the stop.

10. The parcel box according to claim 8, wherein the unblocking mechanism comprises a disengagement mechanism that disengages the catch from the stop.

11. The parcel box according to claim 9, wherein the unblocking mechanism comprises a disengagement mechanism that disengages the catch from the stop.

12. The parcel box according to claim 1, wherein the unblocking mechanism comprises a disengagement mechanism that disengages a catch from the stop.

13. The parcel box according to claim 12, wherein the disengagement mechanism comprises:

a lever having a first end and a second end;

a wire rope;

a rocker arm; and a lock for engagement with the rocker arm, wherein the first end of the lever is mounted on the second cross pivot axle and is fixed to the blocking bracket, and wherein the second end of the lever is connected to the wire rope, which, in turn, is connected to the rocker arm.

14. The parcel box according to claim 12, wherein the disengagement mechanism comprises:

a wire rope;

a rocker arm; and a lock, wherein the first end of the wire rope is fixed to the second end of the blocking bracket, and wherein the second end of the wire rope is connected to the rocker arm.

15. The parcel box according to claim 1, wherein the parcel box is combined with a mail box comprising a box which is mounted on a frontal part of the drawer and a pivotally mounted door with a letter opening, a handle or door's support and lock.

16. The parcel box according to claim 15, wherein a wall of the mail box, which is opposite to the door is equipped with a holding mechanism that releasably holds the wall in the closed position, and wherein the wall is swingably mounted on the drawer so that an upper part of the wall can be put down on the second end of the platform, thereby causing a catch to engage with the stop.

17. The parcel box according to claim 1, wherein the drawer comprises a signaling device provided by a color label, notch or cut off on a peripheral or outer part allowing a user to distinguish between empty and parcel inside positions.

18. The parcel box according to claim 17, wherein the signaling device comprises:

a signaling mechanism comprising a disc mounted pivotally on a cramp and placed in a slit in an outer wall of the drawer so that a peripheral part of the signaling mechanism is visible outside of the parcel box; and a lever having a first and a second end, wherein the first end is pivotally connected to an axle on the signaling mechanism and the second end is fastened to the first end of the platform.

19. The parcel box according to claim 17, wherein the signaling device comprises:

a signaling mechanism comprising a plate placed in parallel to an outer wall of the drawer on a level of an aperture in the outer wall so that the outer part of the signaling mechanism is visible through the aperture in the outer wall of the drawer, the signaling mechanism being mounted so as to allow vertical sliding translational movement along the outer wall of the drawer; and a lever having a first and a second end, wherein the first end is swingably connected to an axle on the signaling mechanism and the second end is fastened to the first end of the platform.

* * * * *